US008829981B2

(12) United States Patent
Peachey et al.

(10) Patent No.: US 8,829,981 B2
(45) Date of Patent: Sep. 9, 2014

(54) LOCAL VOLTAGE CONTROL FOR ISOLATED TRANSISTOR ARRAYS

(71) Applicant: RF Micro Devices, Inc., Greensboro, NC (US)

(72) Inventors: Nathaniel Peachey, Oak Ridge, NC (US); Ralph Christopher Nieri, Summerfield, NC (US)

(73) Assignee: RF Micro Devices, Inc., Greensboro, NC (US)

( * ) Notice: Subject to any disclaimer, the term of this patent is extended or adjusted under 35 U.S.C. 154(b) by 0 days.

(21) Appl. No.: 13/889,583

(22) Filed: May 8, 2013

(65) Prior Publication Data

US 2014/0091858 A1 Apr. 3, 2014

Related U.S. Application Data

(60) Provisional application No. 61/707,417, filed on Sep. 28, 2012, provisional application No. 61/790,601, filed on Mar. 15, 2013.

(51) Int. Cl.
*G05F 1/10* (2006.01)
*G05F 3/02* (2006.01)

(52) U.S. Cl.
USPC ..... 327/537; 330/254

(58) Field of Classification Search
USPC ..... 327/537; 330/254
See application file for complete search history.

(56) References Cited

U.S. PATENT DOCUMENTS 5,017,811 A * 5/1991 Worley ..... 326/71
6,462,364 B1 * 10/2002 Horiuchi ..... 257/288
7,263,337 B2 8/2007 Struble
7,898,329 B1 * 3/2011 Clara et al. ..... 330/254
2002/0195623 A1 * 12/2002 Horiuchi ..... 257/200
2003/0001208 A1 * 1/2003 Forbes et al. ..... 257/347
2007/0152934 A1 * 7/2007 Maeda ..... 345/92
2008/0084365 A1 * 4/2008 Takahara et al. ..... 345/76
2009/0261417 A1 * 10/2009 Jou et al. ..... 257/355
2010/0277401 A1 * 11/2010 Takahara et al. ..... 345/76
2012/0049929 A1 * 3/2012 Liou ..... 327/427
2013/0064021 A1 * 3/2013 La Rosa ..... 365/189.09
2013/0258535 A1 * 10/2013 Kim et al. ..... 361/56

OTHER PUBLICATIONS

Nebel, Gerhard et al., "A Very Low Drop Voltage Regulator Using and NMOS Output Transistor,"IEEE International Symposium on Circuits and Systems ISCAS 2005, Copyright: 2005, pp. 3857-3860.
You, Kwangrok et al., "900 MHz CMOS RF-to-DC Converter Using a Cross-Coupled Charge Pump for Energy Havesting," IEEE International Symposium on Radio-Frequency Integration Technology (RFIT), Nov. 30-Dec. 2, 2011, pp. 149-152, Beijing, China.

* cited by examiner

*Primary Examiner* — Ryan Jager
(74) *Attorney, Agent, or Firm* — Withrow & Terranova, P.L.L.C.

(57) ABSTRACT

Self-biasing transistor switching circuitry includes a main transistor, a biasing transistor, a first capacitor, and a second capacitor. The body of the main transistor is isolated from the gate, the drain, and the source of the main transistor by an insulating layer. The first capacitor is coupled between the source and the gate of the main transistor. The second capacitor is coupled between the source and the body of the main transistor. The body and the drain of the main transistor are coupled together. The gate and the drain of the biasing transistor are coupled to the gate of the main transistor. The drain of the biasing transistor is coupled to the drain of the main transistor. The self-biasing transistor switching circuitry is adapted to receive an oscillating signal at the drain of the main transistor, and use the oscillating signal to appropriately bias the main transistor.

22 Claims, 13 Drawing Sheets

LOCAL VOLTAGE CONTROL FOR ISOLATED TRANSISTOR ARRAYS

RELATED APPLICATIONS

This application claims the benefit of U.S. provisional patent application Ser. No. 61/707,417, filed Sep. 28, 2012, and U.S. provisional patent application Ser. No. 61/790,601, filed Mar. 15, 2013, the disclosures of which are hereby incorporated by reference in their entirety.

FIELD OF THE DISCLOSURE

The present disclosure relates to circuitry for biasing a transistor, and specifically to circuitry for biasing a transistor for use as a switching device without the use of an external power source.

BACKGROUND

Transistors are an integral component in many modern electronic devices. Although used in a variety of applications, many transistors are used as switching devices. Transistors used as switching devices generally require biasing circuitry including an active power supply. The active power supply for biasing the transistors may decrease the battery life of a mobile device, introduce noise into surrounding circuitry, and consume valuable real estate within a device.

FIG. 1 shows a conventional transistor switching device 10. The conventional transistor switching device 10 includes a transistor TR, a gate resistor RG, a body resistor RB, an input port 12, an output port 14, a gate biasing port 16, and a body biasing port 18. In operation, the conventional transistor switching device 10 is maintained in either an on state or an off state. In an off state, the conventional transistor switching device 10 does not pass a signal at the input port 12 to the output port 14. In an on state, the conventional transistor switching device 10 does pass a signal at the input port 12 to the output port 14. In order to maintain the conventional transistor switching device 10 in an off state, the gate biasing port 16 is generally maintained at a voltage lower than that of the body biasing port 18. Accordingly, biasing circuitry including a negative charge pump is often used to maintain a negative potential between the gate biasing port 16 and the body biasing port 18. Similarly, in order to maintain the conventional transistor switching device 10 in an on state, the gate biasing port 16 is generally maintained at a voltage higher than that of the body biasing port 18. Accordingly, biasing circuitry is often used to maintain a positive potential between the gate biasing port 16 and the body biasing port 18. The negative charge pump may reduce the battery life of a device into which it is incorporated, introduce noise into surrounding circuitry, and consume valuable real estate within a device.

In electronic devices dealing with high amplitude signals, multiple switching elements may be coupled together in order to manage the switching of the signal without damage to each one of the switching elements. FIG. 2 shows a conventional shunt switch array 20 comprising a plurality of conventional transistor switching devices TR1-TRN coupled in series between an input node 24 and ground. Bias control circuitry 26 is coupled to each one of the plurality of conventional transistor switching devices TR1-TRN in order to maintain the conventional transistor switching devices in either an on state or an off state. The bias control circuitry 26 may be adapted to generate a biasing voltage VBIAS based upon a received supply voltage VSUPPLY. In order to generate the biasing voltage VBIAS, the bias control circuitry 26 may contain a negative charge pump, a positive charge pump, or both. The negative charge pump and the positive charge pump may reduce the battery life of a device into which they are incorporated, introduce noise into surrounding circuitry, and consume valuable real estate within a device.

FIG. 3 shows a conventional series switch array 28 comprising a plurality of conventional transistor switching devices TR1-TRN coupled in series between an input node 32 and an output node 34. The bias control circuitry 26 is coupled to each one of the plurality of conventional transistor switching devices TR1-TRN in order to maintain the conventional transistor switching devices in either an on state or an off state. The bias control circuitry 26 may be adapted to generate a biasing voltage VBIAS based upon a received supply voltage VSUPPLY. In order to generate the biasing voltage VBIAS, the bias control circuitry 26 may contain a negative charge pump, a positive charge pump, or both. The negative charge pump and the positive charge pump may reduce the battery life of a device into which they are incorporated, introduce noise into surrounding circuitry, and consume valuable real estate within a device.

FIG. 4 shows details of the bias control circuitry 26 shown in FIGS. 2 and 3. As discussed above, the bias control circuitry 26 may include a charge pump 36 in order to generate the biasing voltage VBIAS. The charge pump 36 may be adapted to generate the biasing voltage VBIAS based on the supply voltage VSUPPLY. As shown in FIG. 4, the charge pump 36 may comprise a flying capacitor CFLY1 including a first terminal 38A and a second terminal 38B, a first charge pump switch SWCP1, a second charge pump switch SWCP2, a third charge pump switch SWCP3, a fourth charge pump switch SWCP4, and a clock generator 40.

The first charge pump switch SWCP1 may be adapted to selectively couple the first terminal 38A of the flying capacitor CFLY to the supply voltage VSUPPLY. The second charge pump switch SWCP2 may be adapted to selectively couple the first terminal 38A of the flying capacitor CFLY to an output node 42. The third charge pump switch SWCP3 may be adapted to selectively couple the second terminal 38B of the flying capacitor CFLY to ground. Finally, the fourth charge pump switch SWCP4 may be adapted to selectively couple the second terminal 38B of the flying capacitor CFLY to the supply voltage VSUPPLY. The clock generator 40 may be coupled to each one of the charge pump switches SWCP1-SWCPY and adapted to control the on or off state of each one of the charge pump switches SWCPI-SWCPY with one or more generated clock signals CLK.

In a charging phase, the first charge pump switch SWCP1 and the third charge pump switch SWCP3 are closed, while the second charge pump switch SWCP2 and the fourth charge pump switch SWCP4 are open, thereby connecting the flying capacitor CFLY between the supply voltage VSUPPLY and ground. Accordingly, the flying capacitor CFLY is charged to approximately the voltage of the supply voltage VSUPPLY. In a pumping phase, the second charge pump switch SWCP2 and the fourth charge pump switch SWCP4 are closed, while the first charge pump switch SWCP1 and the third charge pump switch SWCP3 are open, thereby connecting the flying capacitor CFLY in series between the supply voltage VSUPPLY and the output node 42. Accordingly, because the flying capacitor CFLY has been charged to approximately the supply voltage VSUPPLY, a voltage at the output node 42 is produced that is approximately double the supply voltage VSUPPLY. This process is continuously repeated in order to produce the bias voltage VBIAS.

The charge pump 36 in the bias control circuitry 26 may be a negative charge pump adapted to generate a negative biasing voltage VBIAS, a positive charge pump adapted to generate a positive biasing voltage VBIAS, or both. As is well known in the art, operation of the charge pump switches SWCP1-SWCPY produces noise in the form of signal spurs at or around the switching frequency of the charge pump 36 and harmonics thereof. Further, implementing the charge pump 36 in the bias control circuitry 26 increases the size of the bias control circuitry 26 and adds cost to the design and production of the bias control circuitry 26.

Accordingly, there is a need for transistor switching circuitry that is capable of maintaining an on or an off state without the need for a biasing power supply.

SUMMARY

Self-biasing transistor switching circuitry includes a main transistor, a biasing transistor, a first capacitor, and a second capacitor. The main transistor includes a gate contact, a drain contact, a source contact, and a body contact. The body contact of the main transistor is isolated from the gate contact, the drain contact, and the source contact of the main transistor by an insulating layer. The first capacitor is coupled between the source contact and the gate contact of the main transistor. The second capacitor is coupled between the source contact and the body contact of the main transistor. The body contact and the drain contact of the main transistor are coupled together. The biasing transistor includes a gate contact, a drain contact, and a source contact. The gate contact and the drain contact of the biasing transistor are coupled to the gate contact of the main transistor. The drain contact of the biasing transistor is coupled to the drain contact of the main transistor. The body contact of the biasing transistor is coupled to the body contact of the main transistor. The self-biasing transistor switching circuitry is adapted to receive an oscillating signal at the drain contact of the main transistor, and use the oscillating signal to appropriately bias the main transistor such that it remains in an off state.

According to one embodiment, the gate contact of the biasing transistor is coupled to a switch that is adapted to selectively couple the gate contact of the biasing transistor to either the drain contact or the source contact of the biasing transistor. The self-biasing transistor switching circuitry is adapted to receive an oscillating signal at the drain contact of the main transistor, and use the oscillating signal to appropriately bias the main transistor in either an on or an off state, depending upon the orientation of the switch.

Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

Relative terms such as "below" or "above" or "upper" or "lower" or "horizontal" or "vertical" may be used herein to describe a relationship of one element, layer, or region to another element, layer, or region as illustrated in the Figures. It will be understood that these terms and those discussed above are intended to encompass different orientations of the device in addition to the orientation depicted in the Figures.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art and will not be interpreted in an idealized or overly formal sense unless expressly so defined herein.

Figure 1:
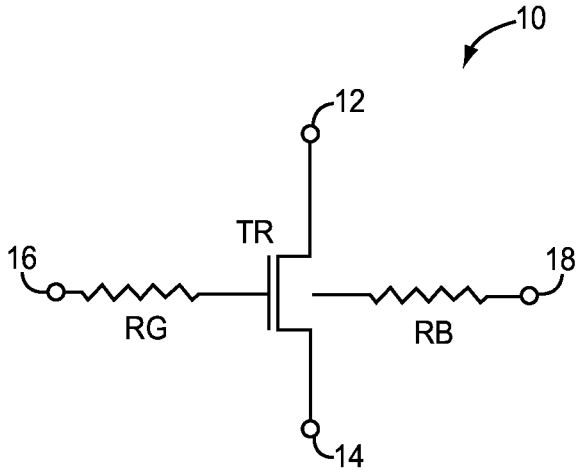
FIG. 1 (RELATED ART)
FIG. 1 is a schematic representation of conventional transistor switching circuitry.
Figure 2:
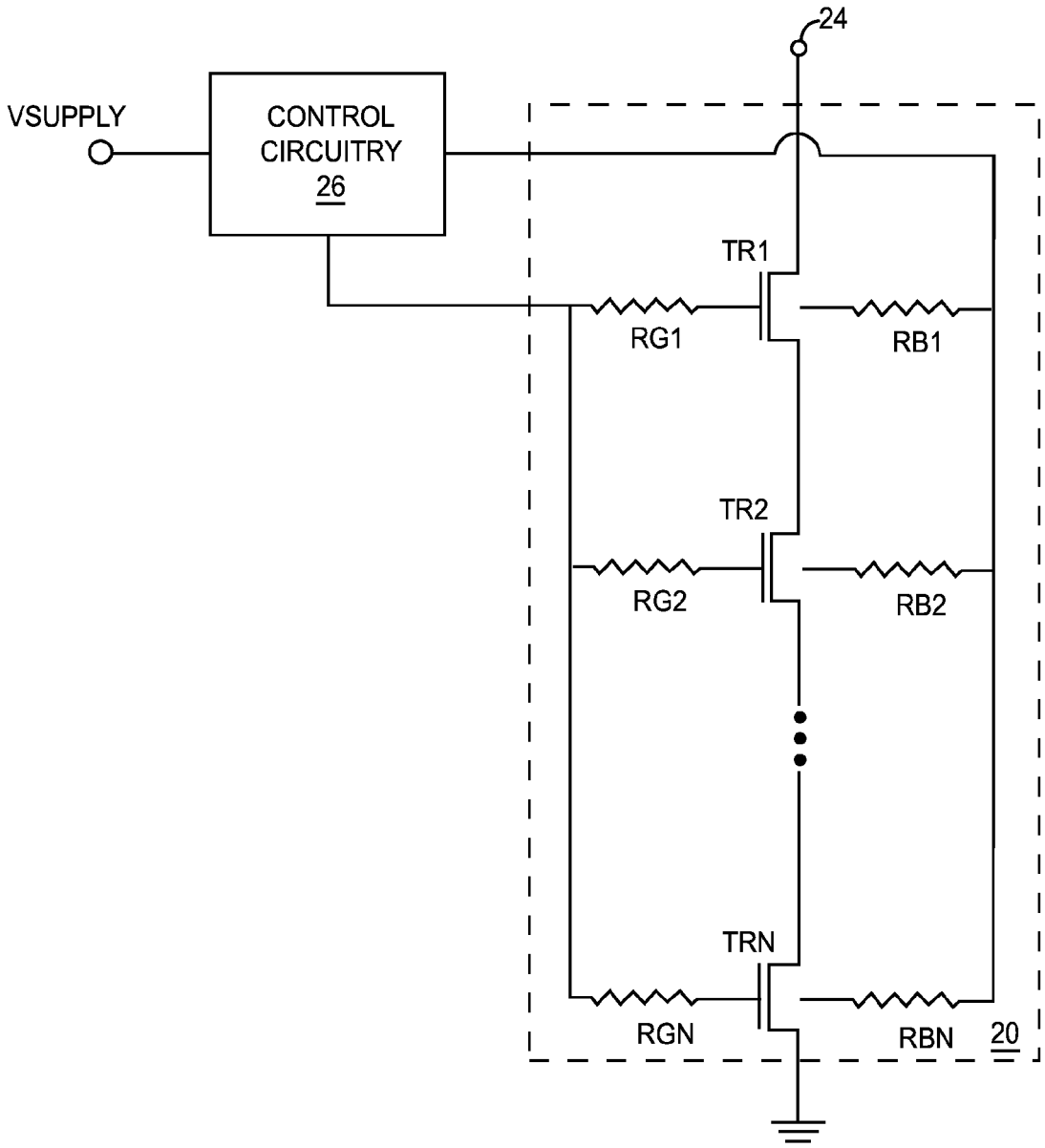
FIG. 2 (RELATED ART)
FIG. 2 is a schematic representation of a conventional shunt switch array.
Figure 3:
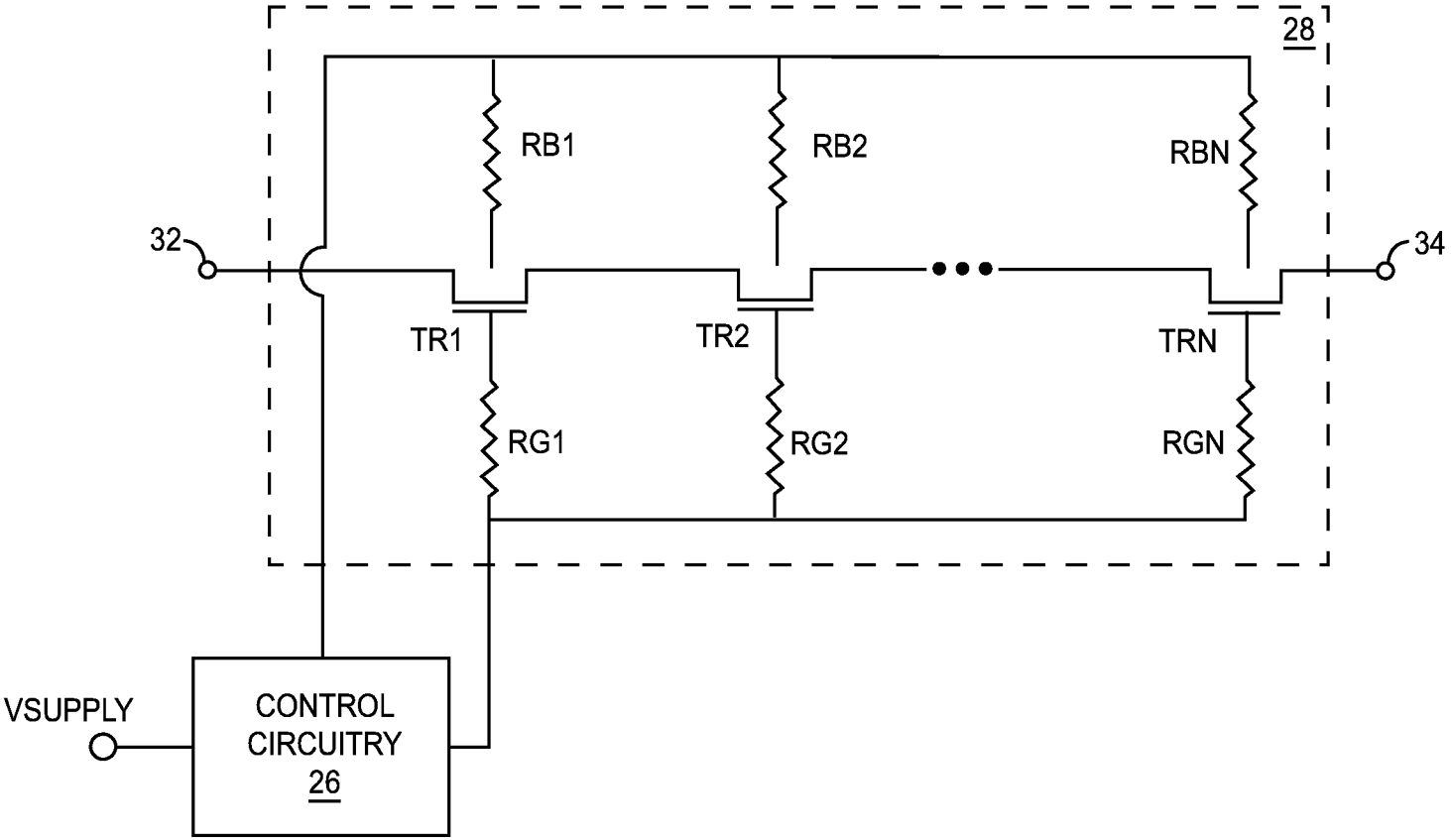
FIG. 3 (RELATED ART)
FIG. 3 is a schematic representation of a conventional series switch array.
Figure 4:
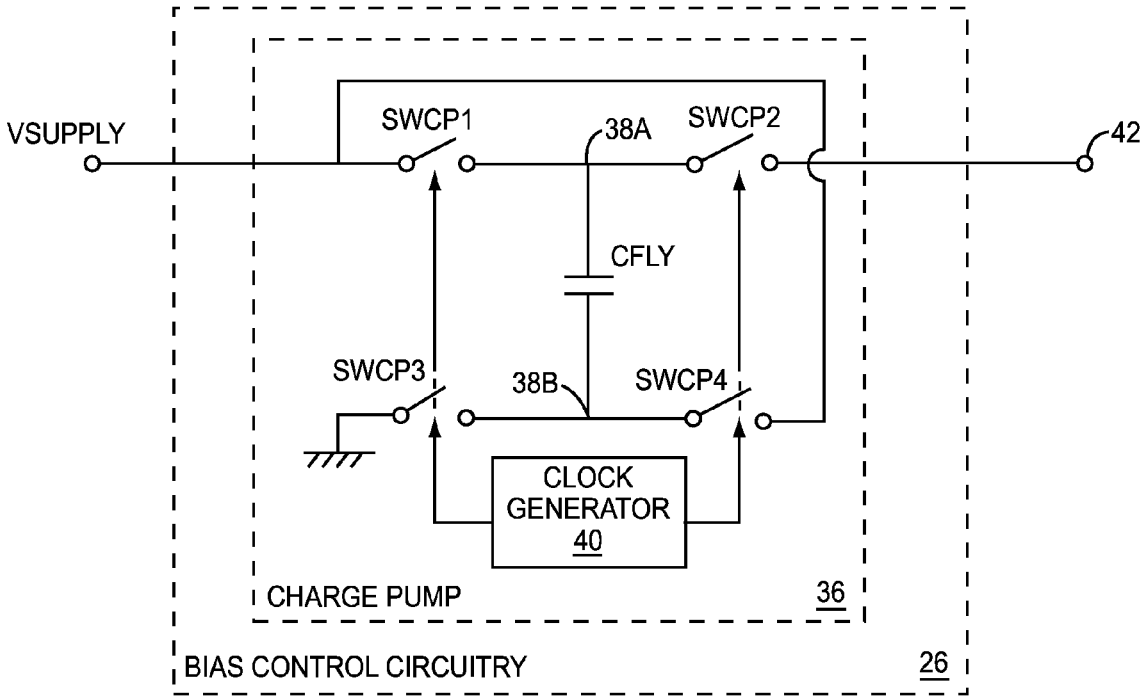
FIG. 4 (RELATED ART)
FIG. 4 is a schematic representation of a charge pump.
Figure 5A:
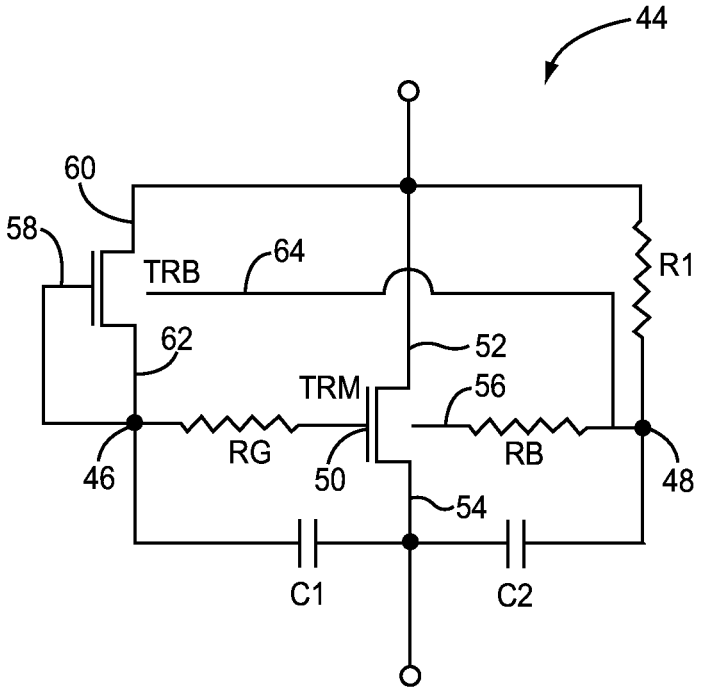
FIGS. 5A and 5B are schematic representations of self-biasing transistor switching circuitry.

Turning now to FIG. 5A, a schematic representation of self-biasing transistor switching circuitry 44 is shown according to the present disclosure. The self-biasing transistor switching circuitry 44 includes a main transistor TRM, a biasing transistor TRB, a first capacitor C1, a second capacitor C2, a gate resistor RG, a body resistor RB, a biasing resistor R1, a first biasing node 46, and a second biasing node 48. The main transistor TRM includes a gate contact 50, a drain contact 52, a source contact 54, and a body contact 56. The body contact 56 of the main transistor TRM is isolated from the gate contact 50, the drain contact 52, and the source contact 54 by an insulating layer. According to one embodiment, the main transistor TRM is a silicon-on-insulator (SOI) device; however, any transistor device having an isolated body may be used in accordance with the present disclosure. The first capacitor C1 is coupled between the first biasing node 46 and the source contact 54 of the main transistor TRM. The second capacitor C2 is coupled between the source contact 54 of the main transistor TRM and the second biasing node 48. According to one embodiment, the biasing resistor R1 is coupled between the second biasing node 48 and the drain contact 52 of the main transistor TRM. According to an additional embodiment, the drain contact 52 of the main transistor TRM is directly coupled to the second biasing node 48.

The biasing transistor TRB includes a gate contact 58, a drain contact 60, a source contact 62, and, according to one embodiment, a body contact 64. The gate contact 58 and the source contact 62 of the biasing transistor TRB are coupled to the first biasing node 46. The drain contact 60 of the biasing transistor TRB is coupled to the drain contact 52 of the main transistor TRM. According to one embodiment, the body contact 64 of the biasing transistor TRB is coupled to the second biasing node 48. The gate contact 50 of the main transistor TRM may be directly coupled to the first biasing node 46, or may be coupled to the first biasing node 46 through the gate resistor RG. The body contact 56 of the main transistor TRM may be directly coupled to the second biasing node 48, or may be coupled to the second biasing node through the body resistor RB.

In operation, the self-biasing transistor switching circuitry 44 is adapted to receive an oscillating signal at the drain contact 52 of the main transistor TRM. The oscillating signal travels through the biasing resistor R1 to the body contact 56 of the main transistor TRM. Due to the RC circuit formed with the biasing resistor R1, the second capacitor C2, the body resistor RB, and the internal resistance attached to the body contact 56 of the main transistor TRM, the oscillating signal will experience a delayed delivery to the body contact 56 of the main transistor TRM. Similarly, due to the RC circuit formed with the first capacitor C1, the gate resistor RG, and the internal capacitance attached to the gate contact 50 of the main transistor TRM, the oscillating signal will experience a delayed delivery to the gate contact 50 of the main transistor TRM. The delay of the oscillating signal to both the body contact 56 and the gate contact 50 of the main transistor TRM is controllable by varying the first capacitor C1, the second capacitor C2, and the biasing resistor R1.

When the first biasing node 46 is at a voltage that is lower than that of the second biasing node 48, the biasing transistor TRB remains in an off state, and the gate contact 50 of the main transistor TRM continues to receive a delayed version of the oscillating signal. When the voltage at the first biasing node 46 is greater than the voltage at the second biasing node 48, such as when the oscillating signal suddenly drops in voltage, the biasing transistor TRB is turned on, thereby lowering the voltage at the first biasing node 46 to the voltage instantaneously present at the drain contact 52 of the main transistor TRM. Accordingly, the gate contact 50 of the main transistor TRM is maintained at a voltage that is lower than that of the body contact 56, thereby maintaining the self-biasing transistor switching circuitry 44 in an off state.

The self-biasing transistor switching circuitry 44 shown in FIG. 5A is designed to be perpetually maintained in an off state. Accordingly, the self-biasing transistor switching circuitry 44 may be useful in certain applications such as the management of electrostatic discharge (ESD). One or more self-biasing transistor switching circuits may be connected in series in order to form a shunt ESD protection device, as will be discussed in further detail below.

Figure 5B:
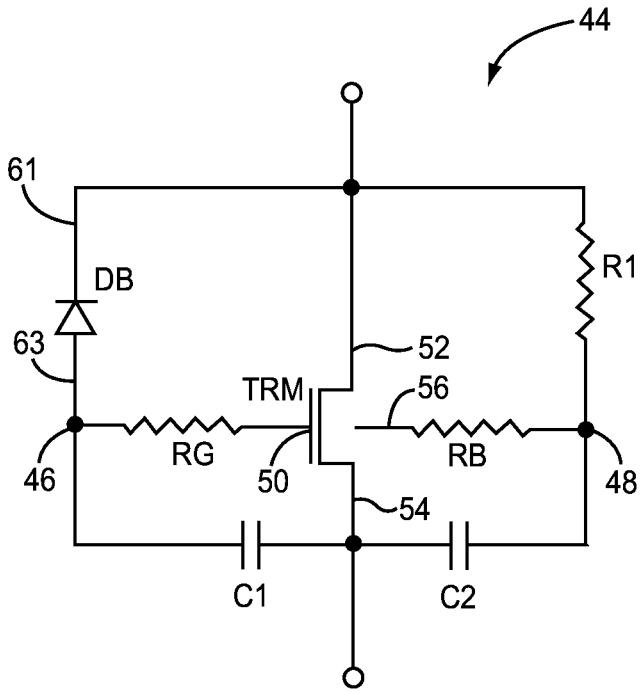

FIG. 5B is a schematic representation of self-biasing transistor switching circuitry 44 shown in FIG. 5A according to an alternative embodiment of the present disclosure. According to this embodiment, the biasing transistor TRB in the self-biasing transistor circuitry 44 is replaced with a biasing diode TRB. The biasing diode TRB includes a cathode 61 coupled to the drain of the main transistor TRM and an anode 63 coupled to the gate of the main transistor. The self-biasing transistor switching circuitry 44 shown in FIG. 5B behave substantially similar to the circuitry shown in FIG. 5A.

Figure 6:
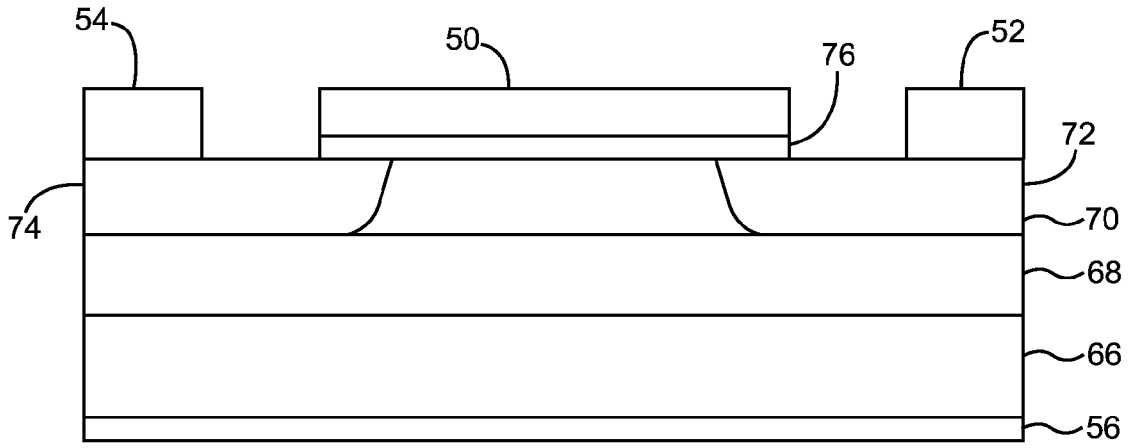
FIG. 6 is a schematic representation of a transistor device.

FIG. 6 shows details of the main transistor TRM according to one embodiment of the present disclosure. According to this embodiment, the main transistor TRM is a SOI metal-oxide semiconductor field effect transistor (MOSFET). As shown in FIG. 6, the main transistor TRM includes the gate contact 50, the drain contact 52, the source contact 54, and the body contact 56. Further, the main transistor TRM includes a substrate layer 66, a buried oxide layer 68, a device layer 70, a drain 72, a source 74, and a gate oxide layer 76. In operation, when there is no voltage present at the gate contact 50 of the main transistor TRM, current does not flow between the drain contact 52 and the source contact 54. When a voltage is applied to the gate contact 50 of the main transistor TRM, a conductive channel is created between the drain 72 and the source 74 of the main transistor TRM. Accordingly, current may flow between the drain contact 52 and the source contact 54 of the main transistor TRM. The amount of current that is allowed to flow from the drain contact 52 to the source contact 54 of the main transistor TRM is proportional to the size of the conductive channel present in the device layer 70, which is directly controlled by the voltage present at the gate contact 50 of the main transistor TRM. Due to the buried oxide layer 68 present in the main transistor TRM, an internal resistance is realized between the gate contact 50 and the body contact 56.

Although a SOI MOSFET is shown in FIG. 6, any transistor device having an isolated body may be used as the main transistor TRM and the biasing transistor TRB without departing from the principles of the present disclosure.

Figure 7:
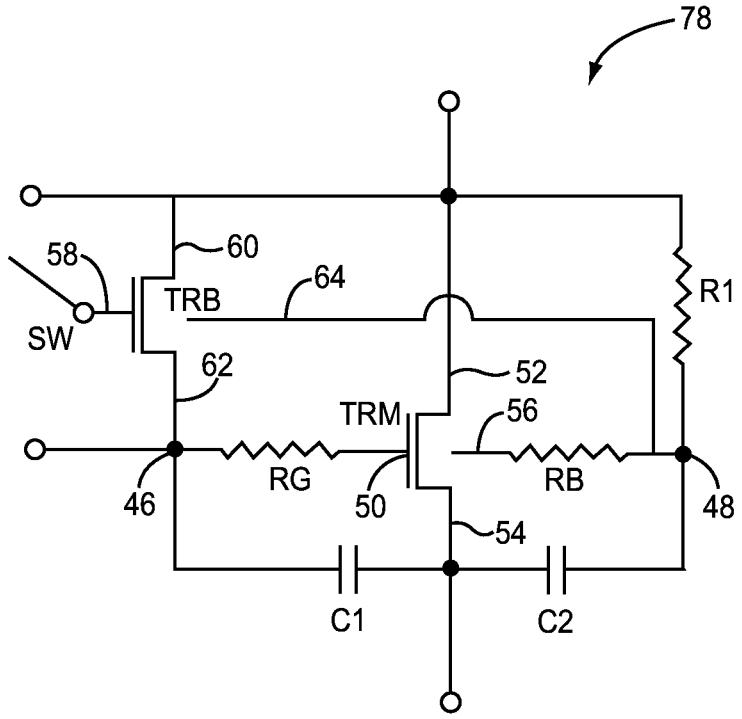
FIG. 7 is a schematic representation of an additional embodiment of self-biasing transistor switching circuitry.

FIG. 7 shows a schematic representation of self-biasing transistor switching circuitry 78 according to an additional embodiment of the present disclosure. The self-biasing transistor switching circuitry 78 shown in FIG. 7 is substantially similar to that shown in FIG. 5, but further includes a switch SW for selectively coupling the gate contact 58 of the biasing transistor TRB to either the first biasing node 46 or the drain contact 52 of the main transistor TRM. By adding the switch SW, the self-biasing transistor switching circuitry 78 can be maintained in either an on state or an off state using the oscillating input signal. When the switch SW couples the gate contact 58 of the biasing transistor TRB to the first biasing node 46, the self-biasing transistor switching circuitry 78 functions as described above, and is adapted to remain in an off state. When the switch SW couples the gate contact 58 of the biasing transistor TRB to the drain contact 52 of the main transistor TRM, the self-biasing transistor switching circuitry 78 is adapted to remain in an on state.

When adapted to remain in an on state, the self-biasing transistor switching circuitry 78 will continue to receive the oscillating signal at the drain contact 52 of the main transistor TRM. The oscillating signal will experience a delayed delivery to the body contact 56 and the gate contact 50 of the main transistor TRM, as described above. When the voltage at the second biasing node 48 is lower than the voltage at the drain contact 52 of the main transistor TRM, the biasing transistor TRB will be turned on, thereby increasing the voltage at the first biasing node 46 to the voltage instantaneously present at the drain contact 52 of the main transistor TRM. When the voltage at the second biasing node 48 is greater than the voltage at the drain contact 52 of the main transistor TRM, the biasing transistor TRB will remain off, and the first biasing node 46 will continue to receive a delayed version of the oscillating signal. Accordingly, the gate contact 50 of the main transistor TRM is maintained at a voltage that is greater than that of the body contact 56, and the self-biasing transistor switching circuitry 78 is maintained in an on state.

By altering the orientation of the switch SW, the self-biasing transistor switching circuitry 78 can be maintained in either an on state or an off state using the oscillating input signal. Although the self-biasing transistor switching circuitry 78 may require additional control circuitry (not shown) in order to change the orientation of the switch SW, the control circuitry does not require an active power supply, thereby saving power, space, and reducing noise in a device into which the self-biasing transistor switching circuitry 78 is integrated.

According to one embodiment, the switch SW is a transistor switching device. For example, the switch SW could be implemented as a bipolar junction transistor (BJT), field effect transistor (FET), or MOSFET device.

Figure 8:
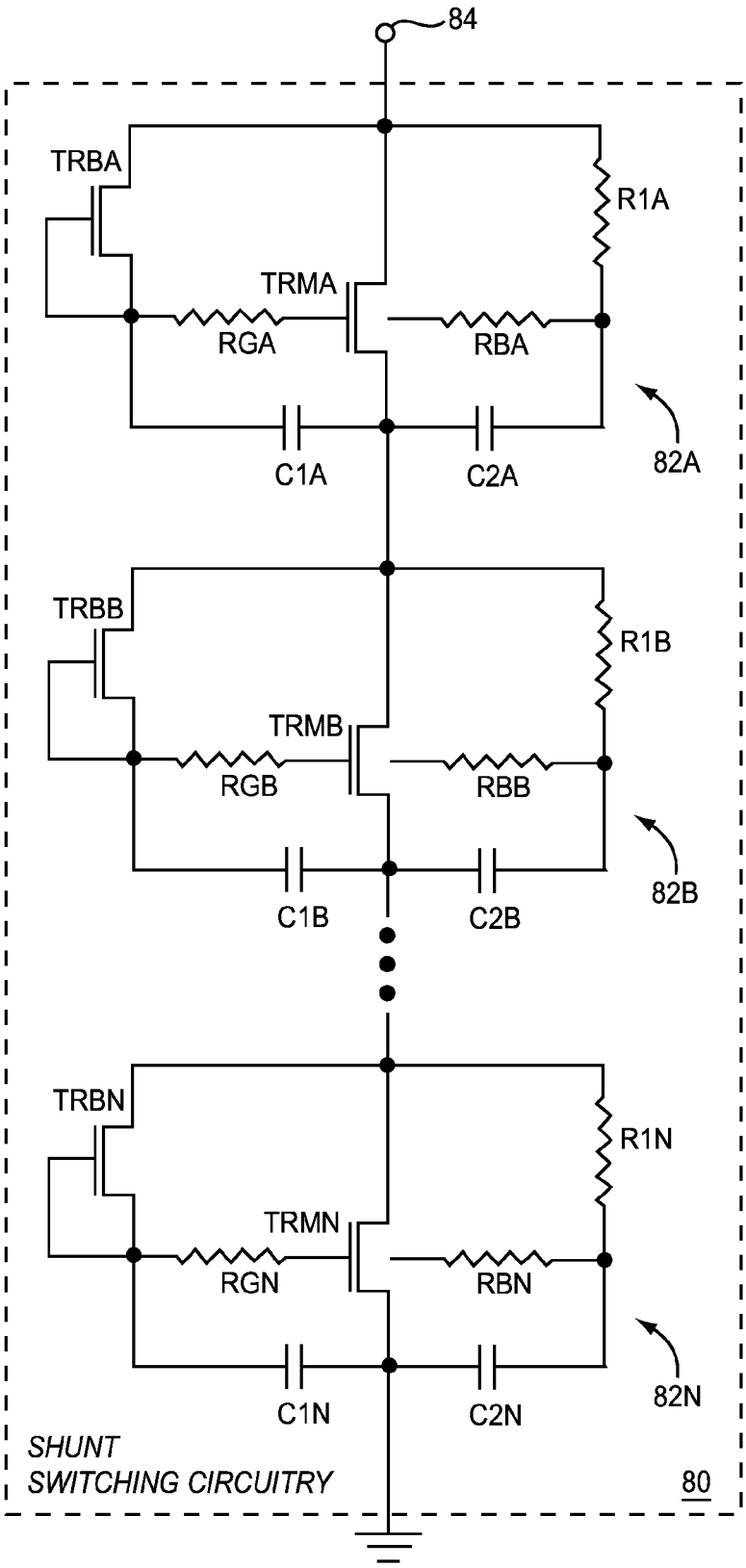
FIG. 8 is a schematic representation of self-biasing shunt switch circuitry.

FIG. 8 shows a schematic representation of shunt switching circuitry 80 according to the present disclosure. The shunt switching circuitry 80 comprises a plurality of self-biasing transistor switching circuits 82A-82N coupled in series between an input node 84 and ground. Each one of the self-biasing transistor switching circuits 82A-82N are adapted to be perpetually maintained in an off state. Accordingly, the shunt switching circuitry 80 may be used, for example, to prevent damage to circuitry from ESD. By maintaining each one of the self-biasing transistor switching circuits 82A-82N in an off state, ESD present at the input node 84 will be safely diverted to ground, and will not cause damage to surrounding circuitry. By using a plurality of self-biasing transistor switching circuits 82A-82N to form the shunt switching circuitry 80, the use of an active power supply to bias the shunt switching circuitry 80 can be avoided, thereby saving power, space, and reducing noise in a device into which the shunt switching circuitry 80 is integrated.

During an ESD event, ESD present at the input node 84 will travel to the drain of the first self-biasing transistor switching circuit 82A. Since each one of the self-biasing transistor switching circuits 82A-82N are maintained in an off state, current will not flow from the drain of a first main transistor TRMA to the source of the first main transistor TRMA. Accordingly, the drain-to-gate and the drain-to-source voltage of the first main transistor TRMA will rise. As the voltage between the gate and the drain of the first main transistor TRMA approaches the breakdown voltage of the first main transistor TRMA, a leakage current will flow from the drain to the gate. This leakage current is placed across the gate resistor RG, and causes the gate-to-source voltage of the first main transistor TRMA to rise. Once the gate-to-source voltage reaches the threshold voltage of the first main transistor TRMA, the first main transistor TRMA is turned on, and current is allowed to flow from the drain to the source. This process is repeated with each transistor in the shunt switching circuitry 80 until the ESD presented at the input node 84 is safely diverted to ground.

Figure 9:
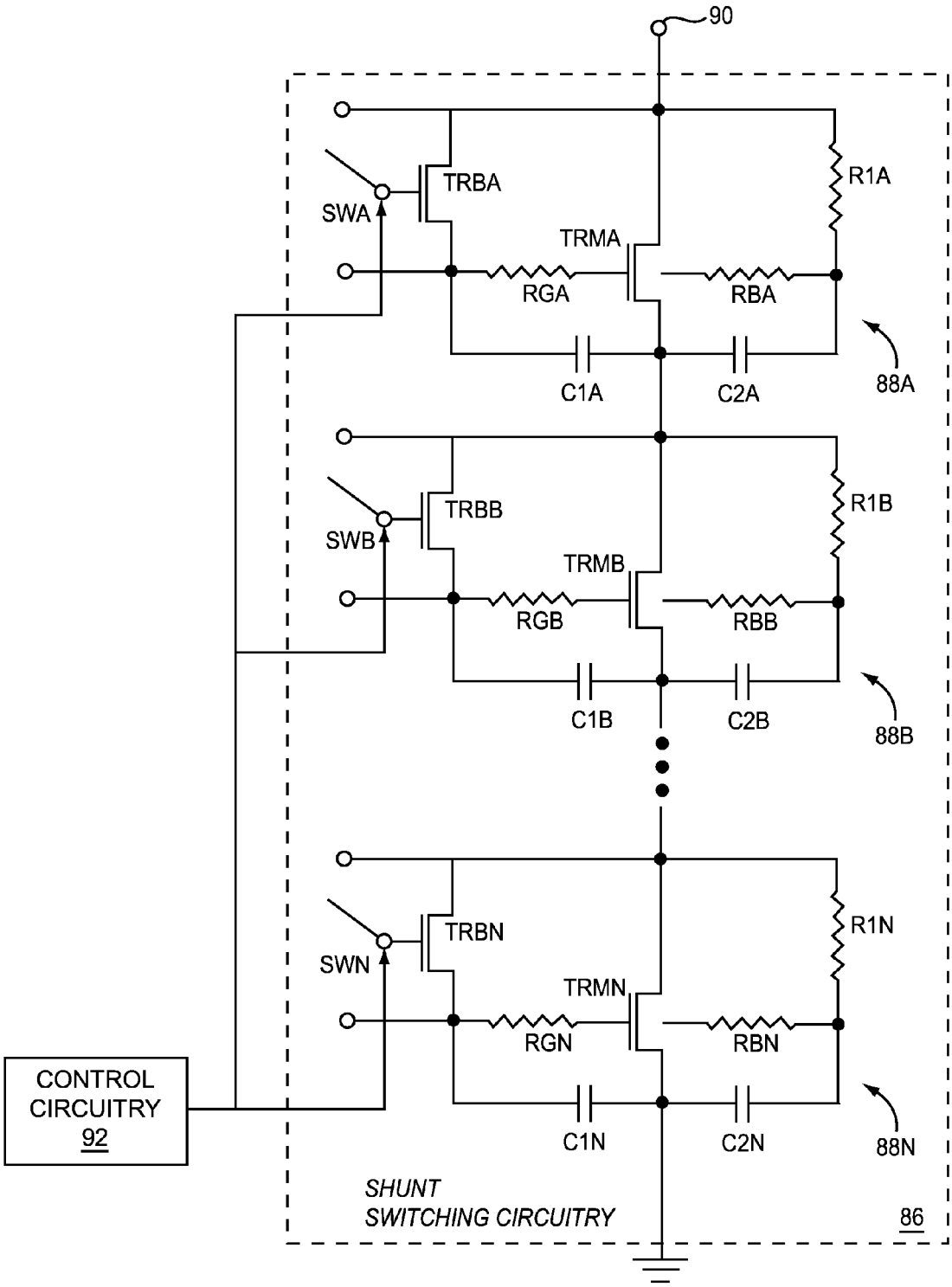
FIG. 9 is a schematic representation of an additional embodiment of self-biasing shunt switch circuitry.

FIG. 9 shows a schematic representation of shunt switching circuitry 86 according to an additional embodiment of the present disclosure. According to this embodiment, the shunt switching circuitry 86 comprises a plurality of self-biasing transistor switching circuits 88A-88N coupled between an input node 90 and ground. Each one of the plurality of self-biasing transistor switching circuits 88A-88N are adapted to be maintained in either an on state or an off state depending on the orientation of each one of the switches SW, as described above. The plurality of self-biasing transistor switching circuits 88A-88N are coupled to control circuitry 92, which is adapted to switch the plurality of self-biasing transistor switching circuits 88A-88N between an on state and an off state. By using the plurality of self-biasing transistor switching circuits 88A-88N, the use of an active power supply within the control circuitry 92 can be avoided, thereby saving power, space, and reducing noise in a device into which the shunt switching circuitry 86 is integrated.

Figure 10:
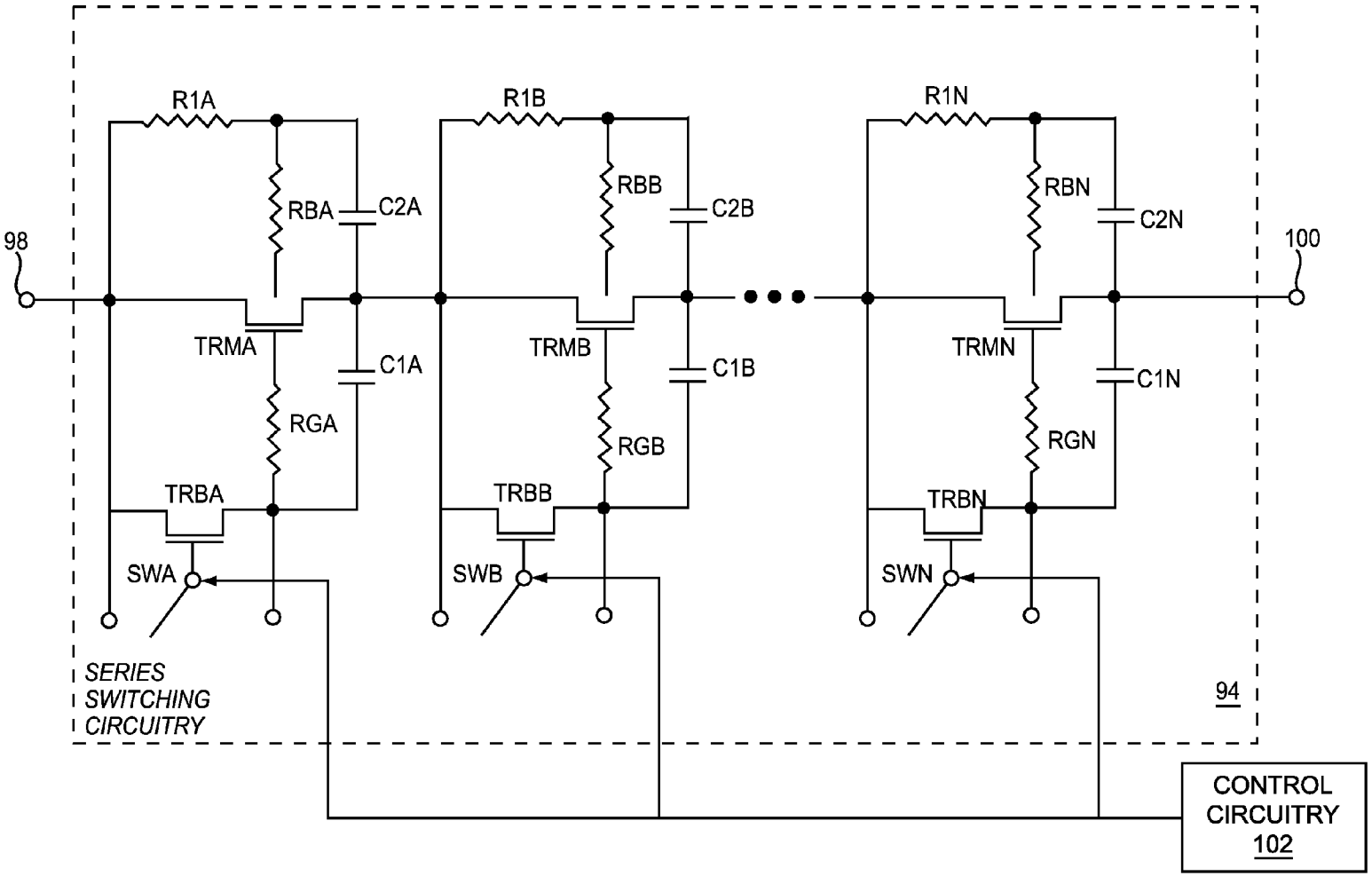
FIG. 10 is a schematic representation of self-biasing series switch circuitry.

FIG. 10 shows a schematic representation of series switching circuitry 94 according to one embodiment of the present disclosure. The series switching circuitry 94 comprises a plurality of self-biasing transistor switching circuits 96A-96N coupled in series between an input node 98 and an output node 100. Each one of the plurality of self-biasing transistor switching circuits 96A-96N are adapted to be maintained in either an on state or an off state depending on the orientation of each one of the switches SW, as described above. The plurality of self-biasing transistor switching circuits 96A-96N are coupled to control circuitry 102, which is adapted to switch the plurality of self-biasing transistor switching circuits 96A-96N between an on state and an off state in order to selectively place the input node 98 in communication with the output node 100. By using a plurality of self-biasing transistor switching circuits 96A-96N, the use of an active power supply within the control circuitry 102 can be avoided, thereby saving power, space, and reducing noise in a device into which the series switching circuitry 94 is integrated.

Figure 11:
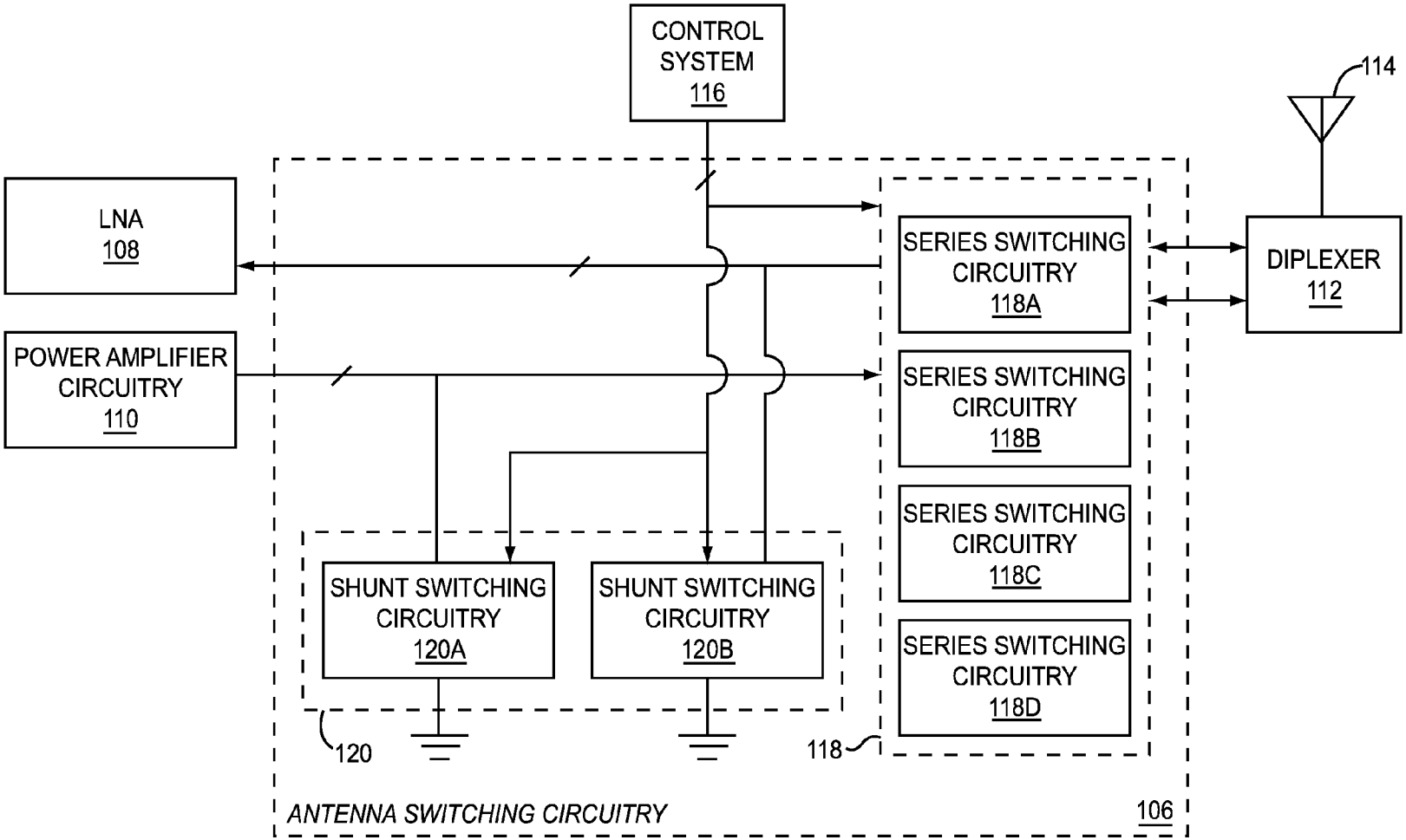
FIG. 11 is a diagram of self-biasing antenna switching circuitry.

FIG. 11 shows antenna switching circuitry 106 for use in a mobile terminal according to the present disclosure. For context, low noise amplifier (LNA) circuitry 108, power amplifier circuitry 110, a diplexer 112, an antenna 114, and control circuitry 116 are also shown. In a receive mode of operation, the antenna 114 receives information bearing radio frequency signals. The radio frequency signals are delivered to the diplexer 112, where they are split into their low frequency and high frequency components and delivered to the antenna switching circuitry 106. According to one embodiment, the antenna switching circuitry 106 includes multiple sets of series switching circuitry 118. Each set of the series switching circuitry 118 may be associated with a given frequency band and adapted to selectively pass signals about the associated frequency band to the appropriate receive path in the low noise amplifier circuitry 108. The control circuitry 116 may be adapted to control each set of the series switching circuitry 118 such that the antenna 114 is coupled to the appropriate receive path in the low noise amplifier circuitry 108 for the received signal.

In a transmit mode of operation, the power amplifier circuitry 110 receives a modulated carrier signal, which is amplified and sent to the antenna switching circuitry 106. According to one embodiment, the antenna switching circuitry 106 includes multiple sets of series switching circuitry 118. Each set of series switching circuitry 118 may be associated with a given frequency band and adapted to selectively pass signals about the associated frequency band to the antenna 114 through the diplexer 112. The control circuitry 116 may be adapted to control each set of series switching circuitry 118 such that the antenna 114 is coupled to the appropriate transmit path in the power amplifier circuitry 110 for the transmitted signal.

According to one embodiment, the antenna switching circuitry 106 includes multiple sets of shunt switching circuitry 120. Each set of shunt switching circuitry 120 may be adapted to selectively couple one or more transmit paths in the power amplifier circuitry 110 or one or more receive paths in the low noise amplifier circuitry 108 to ground. The control circuitry 116 may be adapted to control each set of shunt switching circuitry 120 such that undesirable signals, such as ESD and noise, are diverted away from the antenna switching circuitry 106 to ground.

The antenna switching circuitry 106 may be made up of a plurality of self-biasing transistor switching circuits, as described above. Accordingly, the use of an active power supply within the control circuitry 116 can be avoided, thereby saving power, space, and reducing noise in the mobile terminal into which the antenna switching circuitry 106 is integrated.

Figure 12:
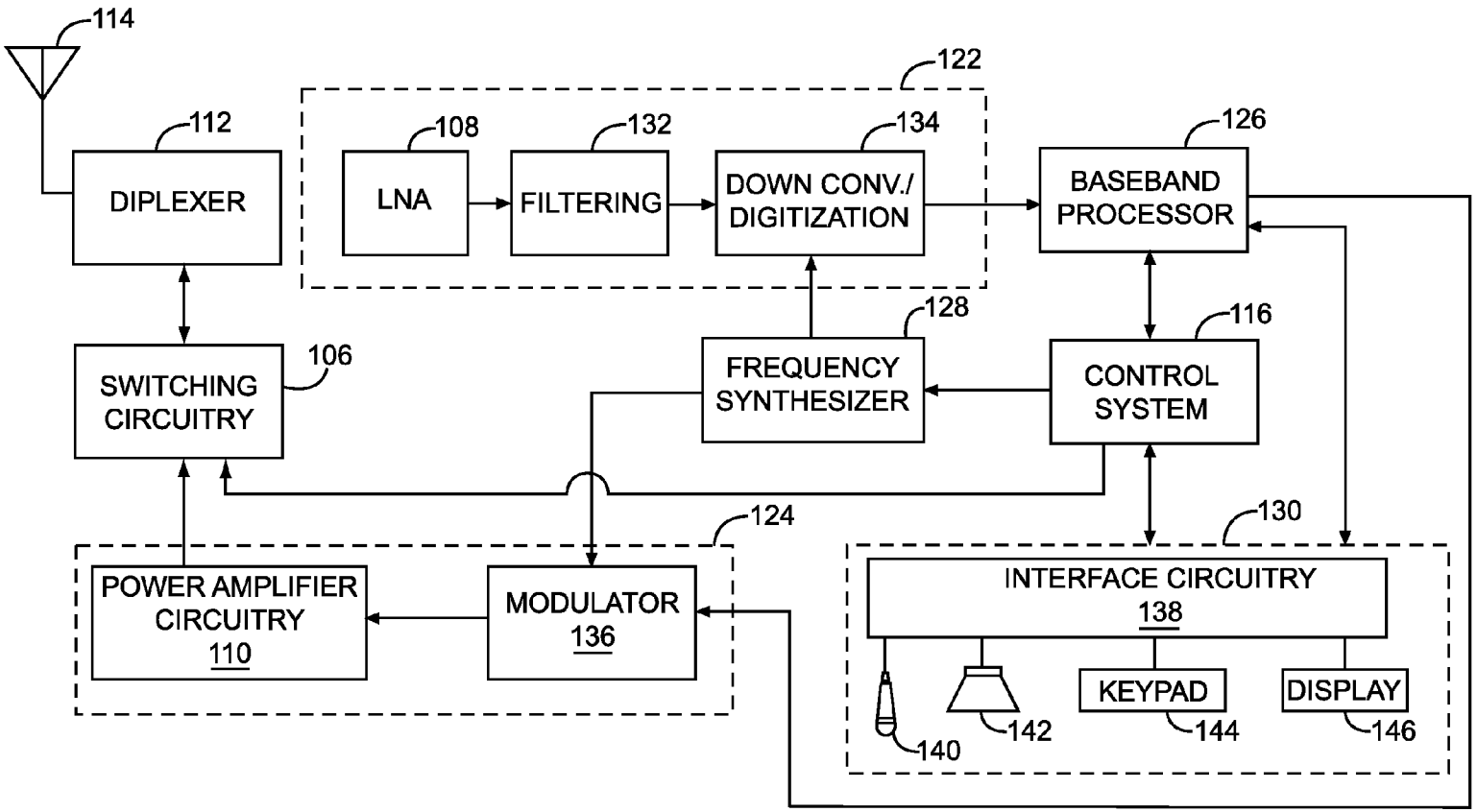
FIG. 12 is a diagram of a mobile terminal including self-biasing antenna switching circuitry.

FIG. 12 shows the basic architecture of a mobile terminal 104 incorporating the antenna switching circuitry 106 of FIG. 11. The mobile terminal 104 may include a receiver front end 122, a radio frequency transmitter section 124, the antenna 114, the diplexer 112, a baseband processor 126, the control circuitry 116, a frequency synthesizer 128, and an interface 130. As discussed above, the antenna 114 receives information bearing radio frequency signals from one or more remote transmitters provided by a base station (not shown). The radio frequency signals are delivered to the diplexer 112, which separates the low and high frequency components of the radio frequency signals and delivers them to the antenna switching circuitry 106. The antenna switching circuitry 106 selectively places one or more terminals of the diplexer 112 into communication with one or more terminals of the low noise amplifier circuitry 108 within the receiver front end 122. The low noise amplifier circuitry 108 then amplifies the signal. Filter circuitry 132 minimizes broadband interference in the received signal, while down conversion and digitization circuitry 134 down converts the filtered, received signal to an intermediate or baseband frequency signal, which is then digitized into one or more digital streams. The receiver front end 122 typically uses one or more mixing frequencies generated by the frequency synthesizer 128. The baseband processor 126 processes the digitized received signal to extract the information or data bits conveyed in the received signal. This processing typically comprises demodulation, decoding, and error correction operations. As such, the baseband processor 126 is generally implemented in one or more digital signal processors (DSPs).

On the transmit side, the baseband processor 126 receives digitized data, which may represent voice, data, or control information, from the control circuitry 116, which it encodes for transmission. The encoded data is output to the radio frequency transmitter section 124, where it is used by a modulator 136 to modulate a carrier signal at a desired transmit frequency. The power amplifier circuitry 110 amplifies the modulated carrier signal to a level appropriate for transmission, and delivers the amplified and modulated carrier signal to the antenna switching circuitry 106. The antenna switching circuitry 106 selectively couples one or more terminals of the power amplifier circuitry 110 to one or more terminals of the diplexer 112 in order to deliver the amplified and modulated signal to the antenna 114.

A user may interact with the mobile terminal 104 via the interface 130, which may include interface circuitry 138 associated with a microphone 140, a speaker 142, a keypad 144, and a display 146. The interface circuitry 138 typically includes analog-to-digital converters, digital-to-analog converters, amplifiers, and the like. Additionally, the interface circuitry 130 may include a voice encoder/decoder, in which case it may communicate directly with the baseband processor 126. The microphone 140 will typically convert audio input, such as a user's voice, into an electrical signal, which is then digitized and passed directly or indirectly to the baseband processor 126. Audio information encoded in the received signal is recovered by the baseband processor 126 and converted by the interface circuitry 138 into an analog signal suitable for driving the speaker 142. The keypad 144 and the display 146 enable the user to interact with the mobile terminal 104, input numbers to be dialed, address book information, or the like, as well as monitor call progress information.

Those skilled in the art will recognize improvements and modifications to the preferred embodiments of the present disclosure. All such improvements and modifications are considered within the scope of the concepts disclosed herein and the claims that follow.

What is claimed is:

1. Circuitry comprising:

a main transistor including a gate contact, a drain contact, a source contact, and a body contact, wherein the body contact and the drain contact of the main transistor are coupled together; and biasing circuitry comprising:

a biasing transistor including a gate contact, a drain contact, a source contact, and a body contact, wherein the gate contact and the source contact of the biasing transistor are coupled to the gate contact of the main transistor, the drain contact of the biasing transistor is coupled to the drain contact of the main transistor, and the body contact of the biasing transistor is coupled to the body contact of the main transistor;

a first capacitor coupled between the gate contact and the source contact of the main transistor; and a second capacitor coupled between the source contact and the body contact of the main transistor.

2. The circuitry of claim 1 wherein the biasing circuitry further comprises a resistor coupled between the body contact and the drain contact of the main transistor.

3. The circuitry of claim 1 wherein the body contact of the main transistor is isolated from the gate contact, the drain contact, and the source contact of the main transistor by an insulating layer.

4. The circuitry of claim 1 wherein the main transistor is a semiconductor on insulator (SOI) device.

5. The circuitry of claim 1 wherein the biasing circuitry is adapted to use an oscillating signal presented at the drain contact of the main transistor to bias the main transistor to remain in an off state.

6. Circuitry comprising:

a main transistor including a gate contact, a drain contact, a source contact, and a body contact, wherein the body contact and drain contact of the main transistor are coupled together; and biasing circuitry comprising:

a biasing transistor including a gate contact, a drain contact, a source contact, and a body contact, wherein the source contact of the biasing transistor is coupled to the gate contact of the main transistor, the drain contact of the biasing transistor is coupled to the drain contact of the main transistor, the body contact of the biasing transistor is coupled to the body contact of the main transistor, and the gate contact of the biasing transistor is coupled to a switch adapted to selectively couple the gate contact of the biasing transistor to either the gate contact of the main transistor or the drain contact of the main transistor;

a first capacitor coupled between the gate contact and the source contact of the main transistor; and a second capacitor coupled between the source contact and the body contact of the main transistor.

7. The circuitry of claim 6 wherein the biasing circuitry further includes control circuitry coupled to the switch and adapted to selectively couple the gate contact of the biasing transistor to either the gate contact of the main transistor or the drain contact of the main transistor.

8. The circuitry of claim 7 wherein when the gate contact of the biasing transistor is coupled to the gate contact of the main transistor, the main transistor is in an off state, and when the gate contact of the biasing transistor is coupled to the drain contact of the main transistor, the main transistor is in an on state.

9. Shunt switching circuitry comprising a plurality of self-biasing transistor switching devices coupled between an input terminal and ground, wherein each one of the plurality of self-biasing transistor switching devices comprises:

a main transistor including a gate contact, a drain contact, a source contact, and a body contact, wherein the body contact and the drain contact of the main transistor are coupled together; and biasing circuitry comprising:

a biasing transistor including a gate contact, a drain contact, a source contact, and a body contact, wherein the gate contact and the source contact of the biasing transistor are coupled to the gate contact of the main transistor, the drain contact of the biasing transistor is coupled to the drain contact of the main transistor, and the body contact of the biasing transistor is coupled to the body contact of the main transistor;

a first capacitor coupled between the gate contact and the source contact of the main transistor; and a second capacitor coupled between the source contact and the body contact of the main transistor.

10. The shunt switching circuitry of claim 9 wherein the biasing circuitry further comprises a resistor coupled between the body contact and drain contact of the main transistor.

11. The shunt switching circuitry of claim 9 wherein the body contact of the main transistor is isolated from the gate contact, the drain contact, and the source contact of the main transistor by an insulating layer.

12. The shunt switching circuitry of claim 9 wherein the main transistor is a semiconductor on insulator (SOI) device.

13. The shunt switching circuitry of claim 9 wherein the biasing circuitry is adapted to use an oscillating signal presented at the drain contact of the main transistor to bias the main transistor to remain in an off state.

14. Shunt switching circuitry comprising a plurality of self-biasing transistor switching devices coupled between an input terminal and ground, wherein each one of the plurality of self-biasing transistor switching devices comprises:

a main transistor including a gate contact, a drain contact, a source contact, and a body contact, wherein the body contact and the drain contact of the main transistor are coupled together; and biasing circuitry comprising:

a biasing transistor including a gate contact, a drain contact, a source contact, and a body contact, wherein the source contact of the biasing transistor is coupled to the gate contact of the main transistor, the drain contact of the biasing transistor is coupled to the drain contact of the main transistor, the body contact of the biasing transistor is coupled to the body contact of the main transistor, and the gate contact of the biasing transistor is coupled to a switch adapted to selectively couple the gate contact of the biasing transistor to either the gate contact of the main transistor or the drain contact of the main transistor;

a first capacitor coupled between the gate contact and the source contact of the main transistor; and a second capacitor coupled between the source contact and the body contact of the main transistor.

15. The shunt switching circuitry of claim 14 wherein the biasing circuitry further includes control circuitry coupled to the switch and adapted to selectively couple the gate contact of the biasing transistor to either the gate contact of the main transistor or the drain contact of the main transistor.

16. The shunt switching circuitry of claim 15 wherein when the gate contact of the biasing transistor is coupled to the gate contact of the main transistor, the main transistor is in an off state, and when the gate contact of the biasing transistor is coupled to the drain contact of the main transistor, the main transistor is in an on state.

17. Series switching circuitry comprising a plurality of self-biasing transistor switching devices coupled between an input terminal and an output terminal, wherein each one of the plurality of self-biasing transistor switching devices comprises:

a main transistor including a gate contact, a drain contact, a source contact, and a body contact, wherein the body contact and the drain contact of the main transistor are coupled together; and biasing circuitry comprising:

a biasing transistor including a gate contact, a drain contact, a source contact, and a body contact, wherein the source contact of the biasing transistor is coupled to the gate contact of the main transistor, the drain contact of the biasing transistor is coupled to the drain contact of the main transistor, the body contact of the biasing transistor is coupled to the body contact of the main transistor, and the gate contact of the biasing transistor is coupled to a switch adapted to selectively couple the gate contact of the biasing transistor to either the gate contact of the main transistor or the drain contact of the main transistor;

a first capacitor coupled between the gate contact and the source contact of the main transistor; and a second capacitor coupled between the source contact and the body contact of the main transistor.

18. The series switching circuitry of claim 17 wherein the biasing circuitry further includes control circuitry coupled to the switch and adapted to selectively couple the gate contact of the biasing transistor to either the gate contact of the main transistor or the drain contact of the main transistor.

19. The shunt switching circuitry of claim 18 wherein when the gate contact of the biasing transistor is coupled to the gate contact of the main transistor, the main transistor is in an off state, and when the gate contact of the biasing transistor is coupled to the drain contact of the main transistor, the main transistor is in an on state.

20. Antenna switching circuitry adapted to selectively place an antenna in communication with one or more of a plurality of transmit or receive ports, wherein the antenna switching circuitry comprises a plurality of series switching circuits, and further wherein each one of the plurality of series switching circuits comprises:

a main transistor including a gate contact, a drain contact, a source contact, and a body contact, wherein the body contact and the drain contact of the main transistor are coupled together; and biasing circuitry comprising:

a biasing transistor including a gate contact, a drain contact, a source contact, and a body contact, wherein the source contact of the biasing transistor is coupled to the gate contact of the main transistor, the drain contact of the biasing transistor is coupled to the drain contact of the main transistor, the body contact of the biasing transistor is coupled to the body contact of the main transistor, and the gate contact of the biasing transistor is coupled to a switch adapted to selectively couple the gate contact of the biasing transistor to either the gate contact of the main transistor or the drain contact of the main transistor;

a first capacitor coupled between the gate contact and the source contact of the main transistor; and a second capacitor coupled between the source contact and the body contact of the main transistor.

21. The antenna switching circuitry of claim 20 further comprising a plurality of shunt switching circuits, wherein each one of the plurality of shunt switching circuits comprises:

a main transistor including a gate contact, a drain contact, a source contact, and a body contact, wherein the body contact and the drain contact of the main transistor are coupled together; and biasing circuitry comprising:

a biasing transistor including a gate contact, a drain contact, a source contact, and a body contact, wherein the source contact of the biasing transistor is coupled to the gate contact of the main transistor, the drain contact of the biasing transistor is coupled to the drain contact of the main transistor, the body contact of the biasing transistor is coupled to the body contact of the main transistor, and the gate contact of the biasing transistor is coupled to a switch adapted to selectively couple the gate contact of the biasing transistor to either the gate contact of the main transistor or the drain contact of the main transistor;

a first capacitor coupled between the gate contact and the source contact of the main transistor; and a second capacitor coupled between the source contact and the body contact of the main transistor.

22. The antenna switching circuitry of claim 21 wherein the plurality of shunt switching circuits are adapted to protect the antenna switching circuitry from damage during an electrostatic discharge (ESD) event.

* * * * *